US008868283B2

(12) United States Patent
Geng et al.

(10) Patent No.: US 8,868,283 B2
(45) Date of Patent: Oct. 21, 2014

(54) OIL LIFE MONITORING SYSTEM WITH FUEL QUALITY FACTOR

(75) Inventors: Yunpeng Geng, Northville, MI (US); Andrew E. Buczynsky, Brownstown, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 111 days.

(21) Appl. No.: 13/462,888

(22) Filed: May 3, 2012

(65) Prior Publication Data

US 2013/0297142 A1 Nov. 7, 2013

(51) Int. Cl.

| | |
|---|---|
| ***G01M 17/00*** | (2006.01) |
| ***G01N 33/30*** | (2006.01) |
| ***G06F 7/00*** | (2006.01) |
| ***G06F 11/30*** | (2006.01) |
| ***G07C 5/00*** | (2006.01) |

(52) U.S. Cl.
USPC ..... 701/29.5; 701/29.1

(58) Field of Classification Search
CPC ..... F01M 11/14; F01M 11/10; G07C 5/006; F16N 2660/18
USPC ..... 701/29, 29.1, 29.5
See application file for complete search history.

(56) References Cited

U.S. PATENT DOCUMENTS

| | | | | |
|---|---|---|---|---|
| 4,506,337 | A * | 3/1985 | Yasuhara | 701/29.5 |
| 4,793,977 | A * | 12/1988 | Morris | 422/426 |
| 5,472,878 | A * | 12/1995 | Lewis et al. | 436/61 |
| 5,749,339 | A * | 5/1998 | Graham et al. | 123/73 AD |
| 6,526,335 | B1 * | 2/2003 | Treyz et al. | 701/1 |
| 2006/0193550 | A1 * | 8/2006 | Wawro et al. | 385/12 |
| 2007/0124043 | A1 * | 5/2007 | Ayoub et al. | 701/36 |

* cited by examiner

*Primary Examiner* — Behrang Badii
*Assistant Examiner* — Daniel L Greene
(74) *Attorney, Agent, or Firm* — Quinn Law Group, PLLC

(57) ABSTRACT

An oil-life monitoring system includes an engine revolution counter configured to provide an output corresponding to the rotation of a component of an engine, and a controller in communication with the engine revolution counter. The controller is configured to determine the composition/properties of a fuel being combusted by the engine, and select a fuel quality penalty factor from a table, with the fuel quality penalty factor corresponding to the determined composition/properties of the fuel. Additionally, the controller is configured to compute an adjusted revolution count by multiplying the rotations of the component of the engine by the fuel quality penalty factor, and aggregate the adjusted revolution count.

19 Claims, 2 Drawing Sheets

OIL LIFE MONITORING SYSTEM WITH FUEL QUALITY FACTOR

TECHNICAL FIELD

The present invention relates generally to vehicle oil life monitoring systems.

BACKGROUND

The oil filter assembly and oil used for lubrication of an internal combustion engine (ICE) of a vehicle are consumables having a finite useful life and therefore require periodic replacement to avoid damage to the engine and/or related engine components. At the end of its useful life, the oil may lose its ability to sufficiently lubricate the engine, such that engine components may wear or seize. The oil filter assembly, also commonly referred to as the oil filter, or the filter, at the end of its useful life, may lose its ability to filter contaminants from the oil, water degradation of the filter media may occur, the filter may become blocked such that oil flow through the engine is decreased or stopped, or the filter may otherwise deteriorate such that oil is leaked from the engine through the canister, attachment portion, and/or gasket of the oil filter assembly.

Replacement of the oil filter assembly and the engine oil, where the replacement of both the filter and the oil is commonly referred to as an "oil change," represents an engine operating expense. To minimize this engine operating expense, it is advantageous to maximize the time between oil changes, e.g., it is advantageous to maximize the oil change limit.

Currently, vehicle manufacturers provide a recommended engine oil change limit, which may be alternately expressed in terms of time in service and miles in service, such that when the first occurring one of these limits is met, an oil change is recommended. Because significant damage to the combustion engine and/or vehicle may occur if the oil and/or oil filter is not changed prior to the end of the useful life of the oil and/or oil filter, and because the useful life of the oil filter and the oil vary with the oil quality, customer driving profile, fuel quality, and vehicle geographic location, the vehicle manufacturer's recommended engine oil change limits are typically set based on, for example, near worst case conditions, to minimize the risk of engine damage due to degradation of the oil or the oil filter.

Oil change limits have historically been developed and validated using data obtained from combustion engines in non-hybrid powertrains. Oil change limits correlating to vehicle miles in service, for example, may be based on monitoring engine revolutions of the ICE in the vehicle. In a hybrid powertrain where, for example, the vehicle is operated for a significant portion of time for significant distances using an electric motor or other non-ICE power source, engine operating revolutions (cycles) in service are significantly reduced and no longer correlate to total vehicle miles.

SUMMARY

An oil-life monitoring system includes an engine revolution counter configured to provide an output corresponding to the rotation of a component of an engine and a controller in communication with the engine revolution counter. The controller is configured to: determine the quality of a fuel being combusted by the engine; select a fuel quality penalty factor from a table, the fuel quality penalty factor corresponding to the determined properties of the fuel; compute an adjusted revolution count by multiplying the rotations of the component of the engine by the fuel quality penalty factor; and aggregate the adjusted revolution count. Additionally, the controller may compare the aggregated adjusted revolution count to a threshold, and provide an oil-change alert if the aggregated adjusted revolution count exceeds the threshold.

The system may include a fuel quality sensor in communication with the controller, where the fuel quality sensor is configured to provide the controller with a signal indicative of the properties of the fuel. In one configuration, the fuel quality sensor may monitor the properties of the fuel through spectroscopy.

In another configuration, the system may include a global positioning system receiver configured to output location coordinates corresponding to the location of the system. To determine the fuel quality/composition, the controller may receive the location coordinates of the system from the global positioning system receiver and determine a geographic region (e.g., region, state, country) that corresponds to the detected location. As such, the determined geographic region may then be indicative of a customary and/or government regulated fuel properties.

Additionally, the system may include a temperature sensor in thermal communication with the engine and configured to provide an output signal corresponding to a monitored temperature of the engine. The controller may be further configured to receive the output signal from the temperature sensor, select a temperature penalty factor from a table, and multiply the adjusted revolution count by the temperature penalty factor.

The above features and advantages and other features and advantages of the present invention are readily apparent from the following detailed description of the best modes for carrying out the invention when taken in connection with the accompanying drawings.

DETAILED DESCRIPTION

Figure 1:
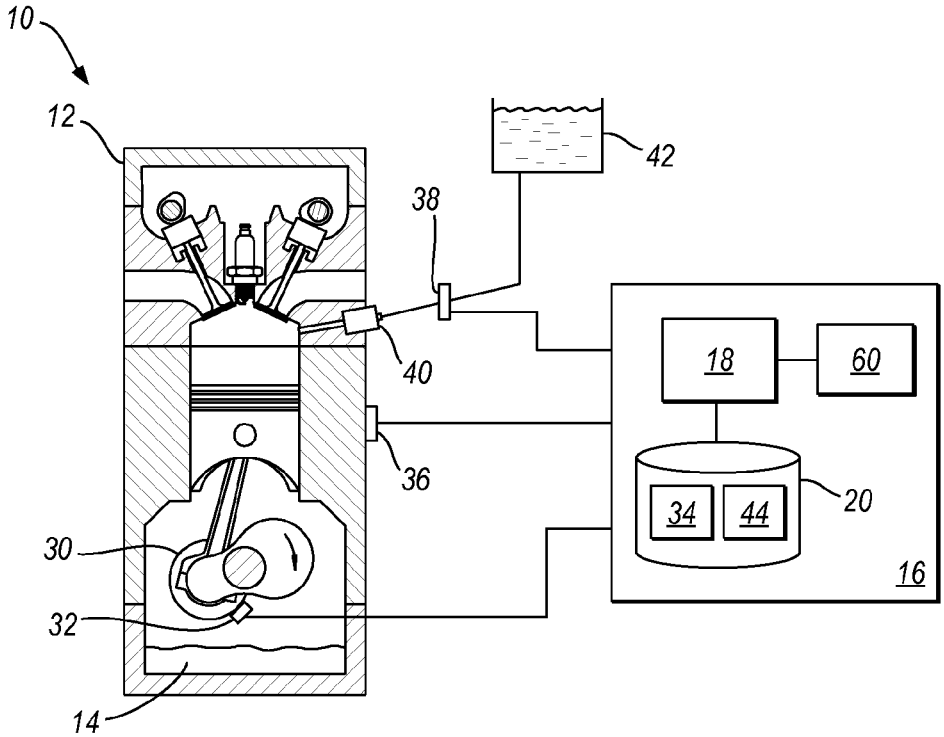
FIG. 1 is a schematic diagram of a vehicle including a first embodiment of an oil life monitoring system.

Referring to the drawings, wherein like reference numerals are used to identify like or identical components in the various views, FIG. 1 schematically illustrates a vehicle 10, such as an automobile, including an engine 12. The engine 12 may be any form of spark-ignited or compression-ignited engine, and may operate on any suitable fuel, such as, without limitation, gasoline, diesel, ethanol blends, and/or ethanol. The engine 12 may include lubricating engine oil 14 that may both reduce the friction between working components of the engine 12 and may remove heat from the local site of combustion. During the operation of the engine 12, the engine oil 14 may break down due to heat, and/or become contaminated due to moisture, engine blowby gasses (i.e., products of combustion that may pass between the engine piston and the cylinder block, and into the crankcase), and/or poorly filtered crankcase ventilation air. This engine oil breakdown/contamination thus necessitates the periodic changing of the engine oil 14.

To estimate the remaining life of the engine oil 14 (i.e., estimated time until an oil change is required), the vehicle 10 may include an oil-life monitoring system 16 that may include a controller 18 and memory 20. The controller 18 may be embodied as one or multiple digital computers or data processing devices, having one or more microcontrollers or central processing units (CPU), read only memory (ROM), random access memory (RAM), electrically-erasable programmable read only memory (EEPROM), a high-speed clock, analog-to-digital (A/D) circuitry, digital-to-analog (D/A) circuitry, input/output (I/O) circuitry, and/or signal conditioning and buffering electronics. The controller 18 may be configured to automatically perform one or more control/processing routines to compute the remaining life of the engine oil 14. Each control/processing routine may be embodied as software or firmware, and may either be stored locally on the controller 18, or may be readily assessable by the controller 18.

During operation of the engine, fuel may be combusted to induce a rotation of one of more components. Once such component may include the engine crankshaft 30. The oil-life monitoring system 16 may operate by counting the number of revolutions/rotations of the engine crankshaft 30 via an engine revolution counter 32. The oil-life monitoring system 16 may continuously compare the total number of accumulated engine revolutions to a threshold 34 stored in the memory 20. Once the threshold has been met, the controller 18 may provide an alert to a user indicating that the oil requires changing.

Additionally, operating the engine at cold temperatures (relative to the normal operating temperature of the engine) may cause the engine to wear at a faster rate than similar operation at the normal operating temperature. This may lead to a decrease in oil life at a more accelerated rate. To account for this cold operation in the oil life calculation, the oil-life monitoring system 16 may include a temperature sensor 36 that may monitor the temperature of the engine 12 and/or engine coolant. The controller 18 may assign a temperature penalty factor to the output of the revolution counter 32 as a function of the monitored engine temperature. For example, during a cold start (i.e., a period of low engine temperature), each crankshaft rotation may be counted as up to 4 rotations (e.g. adding up to a 300% penalty).

Another factor that may prematurely age/degrade the quality of the oil 14 is the quality/composition of the fuel being burned. During engine operation, un-burnt fuel and/or products of combustion may enter the crankcase as blowby gasses. Once in the crankcase, these gasses may dissolve or be suspended within the oil 14, and alter the viscosity or lubrication properties of the oil 14. Therefore, the oil-life monitoring system 16 may also account for fuel quality/composition when determining whether the oil requires changing.

In one configuration, the oil-life monitoring system 16 may include a fuel quality sensor 38 configured to detect the properties of the fuel being burnt. As schematically illustrated in FIG. 1, the fuel quality sensor 38 may be disposed between a fuel injector 40, which may supply the fuel within the engine 12, and a fuel reservoir 42. The fuel quality sensor 38 may detect the composition of the fuel using, for example, spectroscopy, and may include suitable circuitry to monitor the light dispersion and light absorption properties of the fuel across a plurality of wavelengths. In one configuration, the fuel quality sensor 38 may analyze the fuel for the presence of sulfur, aromatics, olefins, ethanol, methanol, inorganic ions, and/or metallic additives. If any of these fuel components are detected in meaningful quantities, the controller 18 may assign a fuel quality penalty factor to the output of the revolution counter 32 as a function of the detected fuel component. For example, in one configuration, any of the following levels may be result in a fuel quality penalty factor being assigned to the output of the revolution counter 32: sulfur levels in excess of 500 ppm (parts per million); aromatic hydrocarbons in excess of 50% by volume; olefin compounds in excess of 10% by volume; ethanol in excess of 1% by volume; methanol in excess of 1% by volume; inorganic ions in excess of 1.0 ppm; higher in distillation profile between T70 to T90, and the presence of metallic additives. Penalty factors for the presence of such fuel components may range between 0% and 900% (i.e., a multiplier of between 1× and 10×), and may proportionally increase with an increasing amount of the component.

In one configuration, the fuel quality penalty factors may be stored in the memory 20 associated with the oil-life monitoring system 16 as a look-up table 44. In this manner, the controller 18 may easily select the appropriate penalty factor based on the determined properties. While the factors may be mere linearly increasing functions above the threshold level, they may alternatively be determined empirically through actual oil monitoring.

Figure 2:
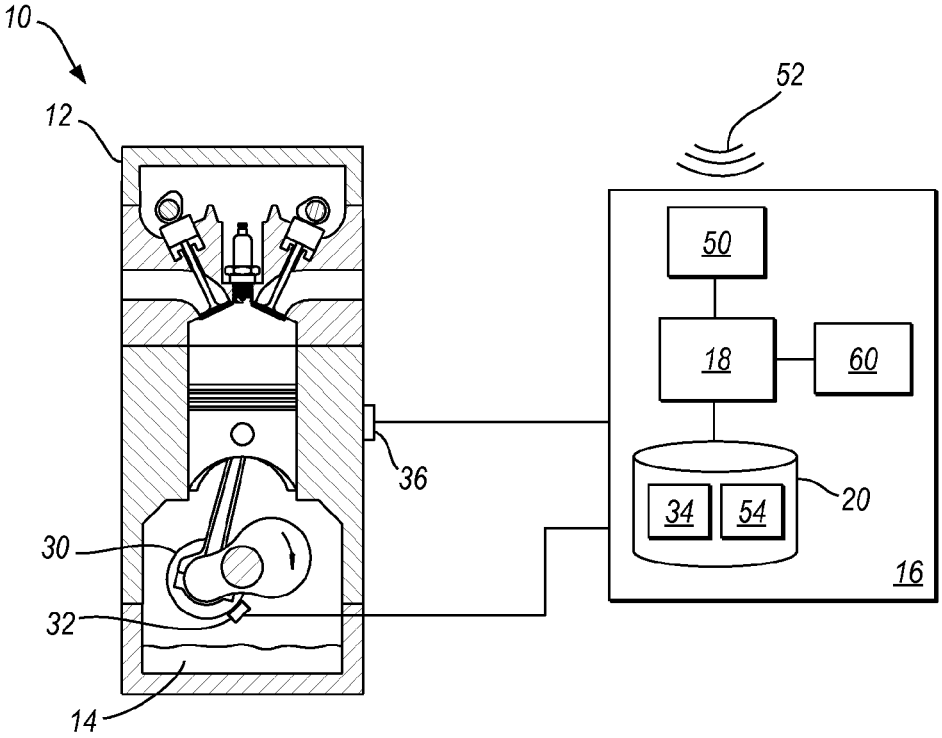
FIG. 2 is a schematic diagram of a vehicle including a second embodiment of an oil life monitoring system.

In another configuration, it may be assumed that all fuel within a particular geographic region has a similar properties. This assumption may be supported by the limited supply base for refined petroleum, together with country-by-country standards that define acceptable gasoline/diesel quality, and fuel quality database. Therefore, instead of including a fuel quality sensor 38 within the oil-life monitoring system 16, such as illustrated in FIG. 1, the oil-life monitoring system 16 may include a global positioning system (GPS) receiver 50, as schematically illustrated in FIG. 2.

The GPS receiver 50 may be configured to locate the vehicle 10 according to known terrestrial coordinates (e.g., latitude, longitude, and elevation) using one or more received GPS signals 52. The controller 18 may translate the determined position into a country or region code, which may be used to select an appropriate fuel quality penalty factor from a catalog of region-specific penalty factors stored as a look-up table 54 in memory 20. The cataloged penalty factors may range between 0% and 900% (i.e., a multiplier of between 1× and 10×), and may be dependent on the predetermined fuel quality within that particular region. In one configuration, each region may be defined as one or more countries. Alternatively, for larger countries such as the United States or China, where different regions have different supply bases for refined petroleum, each region may be defined by the physical area that is supplied by one or more commonly located petroleum refineries. Therefore, in this configuration, the fuel quality penalty factors may be assigned through local or national standards, and/or the custom of the refining industry in a particular locale. In one configuration, the look-up table 54 may be populated using known fuel compositions from the various countries/regions around the world.

Finally, the oil-life monitoring system 16 may include an alert device 60 that may provide an indication of a needed oil-change and/or the remaining oil life to a user/driver of the vehicle 10. To calculate the remaining oil life, the controller 18 may, for example, divide the total number of accumulated revolutions by the threshold number of accumulations to derive a percent oil-life remaining Following an oil-change, this percent may be reset to 100% Oil-Life Remaining In one configuration, the alert device 60 may be a liquid crystal display that may display the oil life percentage when prompted. In another configuration, the alert device may be a warning light that illuminates when the oil life percentage falls below a certain threshold.

Figure 3:
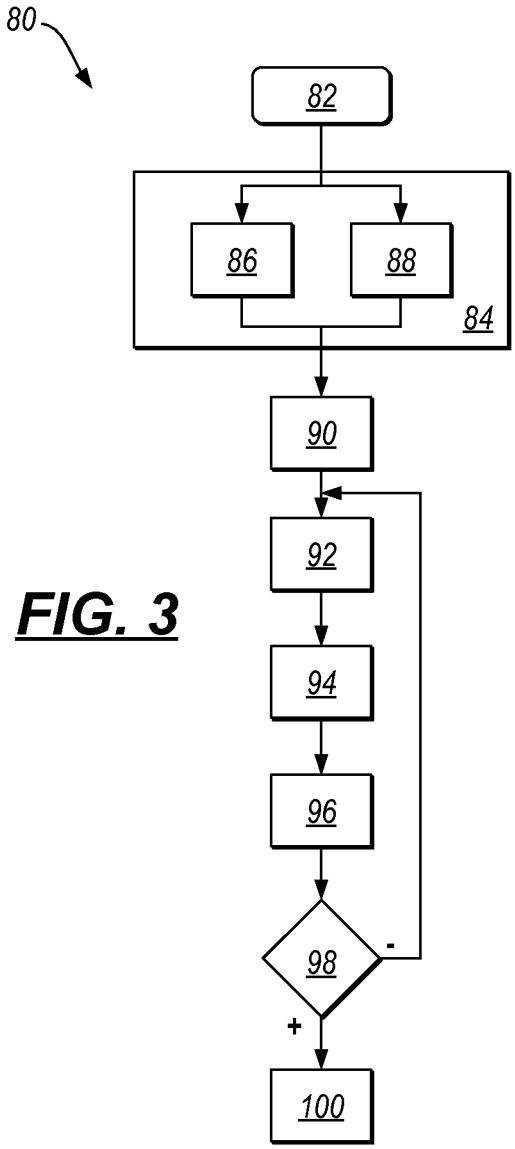
FIG. 3 is a schematic flow diagram of a method of estimating the remaining life of engine oil.

FIG. 3 illustrates a method 80 of estimating the remaining oil life while accounting for fuel quality. The method begins at 82, when the motor turns on and begins combusting fuel. In step 84, the controller 18 determines the fuel quality either by directly testing the composition of the fuel (at 86), such as through spectroscopy, or indirectly by polling the GPS receiver 50 and locating the vehicle within a particular country/region (at 88). Following this determination, in step 90, the controller 18 may use the determined fuel quality to select a fuel quality penalty factor from a table. In one configuration, selecting the penalty factor may include consulting a lookup table stored in a memory 20 associated with the controller 18. Additionally, in step 92, the controller may monitor a temperature of the engine or engine coolant, and may select a temperature penalty factor according to this monitored temperature in step 94.

Once the fuel quality and temperature penalty factors are determined, in step 96, the controller 18 may increment a running counter of raw engine revolutions according to the output of the engine revolution counter 32, multiplied by both the fuel quality and temperature penalty factors (i.e., an adjusted revolution count). This count may be compared to a stored threshold 34 in step 98, where the controller 18 provides an alert (step 100) if the count exceeds the threshold 34 or may continue counting if the threshold is not met.

While the best modes for carrying out the invention have been described in detail, those familiar with the art to which this invention relates will recognize various alternative designs and embodiments for practicing the invention within the scope of the appended claims. It is intended that all matter contained in the above description or shown in the accompanying drawings shall be interpreted as illustrative only and not as limiting.

The invention claimed is:

1. An oil-life monitoring system comprising:

an engine revolution counter configured to provide an output corresponding to the rotation of a component of an engine; and a controller in communication with the engine revolution counter and configured to:

determine the composition of a fuel being combusted by the engine;

select a fuel quality penalty factor from a table, the fuel quality penalty factor corresponding to the determined composition of the fuel;

compute an adjusted revolution count by multiplying the rotations of the component of the engine by the fuel quality penalty factor; and aggregate the adjusted revolution count for use in determining remaining oil-life.

2. The system of claim 1, wherein the controller is further configured to:

compare the aggregated adjusted revolution count to a threshold; and provide an oil-change alert if the aggregated adjusted revolution count exceeds the threshold.

3. The system of claim 1, further comprising a temperature sensor in thermal communication with the engine and configured to provide an output signal corresponding to a monitored temperature of the engine; and wherein the controller is further configured to:

receive the output signal from the temperature sensor select a temperature penalty factor from a table, the temperature penalty factor corresponding to the monitored temperature of the engine; and wherein the adjusted revolution count is further multiplied by the temperature penalty factor.

4. The system of claim 1, further comprising a global positioning system receiver configured to output location coordinates corresponding to the location of the system;

wherein the controller is configured to receive the location coordinates and determine a geographic region corresponding to the received location coordinates; and wherein the determined geographic region is indicative of a fuel composition.

5. The system of claim 1, further comprising a fuel quality sensor in communication with the controller and configured to provide the controller with a signal indicative of the composition of the fuel.

6. The system of claim 5, wherein the fuel quality sensor is configured to monitor the composition of the fuel through spectroscopy.

7. A vehicle comprising:

an engine having a crankshaft and including an engine oil, the engine configured to combust a fuel to rotate the crankshaft;

an oil-life monitoring system in communication with the engine and including:

an engine revolution counter configured to provide an output corresponding to the rotation of the crankshaft; and a controller in communication with the engine revolution counter and configured to:

determine the composition of the fuel;

select a fuel quality penalty factor from a table, the fuel quality penalty factor corresponding to the determined composition of the fuel;

multiply the output of the engine revolution counter by the fuel quality penalty factor to form an adjusted revolution count; and aggregate the adjusted revolution count for use in determining remaining oil-life.

8. The vehicle of claim 7, wherein the controller is further configured to:

compare the aggregated adjusted revolution count to a threshold; and provide an alert if the aggregated adjusted revolution count exceeds the threshold.

9. The vehicle of claim 7, further comprising a global positioning system receiver configured to output location coordinates corresponding to the location of the vehicle;

wherein the controller is configured to receive the location coordinates and determine a geographic region corresponding to the received location coordinates; and wherein the determined geographic region is indicative of a fuel composition.

10. The vehicle of claim 7, further comprising a temperature sensor in thermal communication with the engine and configured to provide an output signal corresponding to a monitored temperature of the engine; and wherein the controller is further configured to:

receive the output signal from the temperature sensor select a temperature penalty factor from a table, the temperature penalty factor corresponding to the monitored temperature of the engine; and wherein the adjusted revolution count is further multiplied by the temperature penalty factor.

11. The vehicle of claim 7, further comprising a fuel quality sensor in communication with the controller and configured to provide the controller with a signal indicative of the composition of the fuel.

12. The vehicle of claim 11, wherein the fuel quality sensor is configured to monitor the composition of the fuel through spectroscopy.

13. The vehicle of claim 11, further comprising a fuel reservoir;

wherein the engine further includes a fuel injector in fluid communication with the fuel reservoir; and wherein the fuel quality sensor is fluidly disposed between the fuel reservoir and the fuel injector.

14. A method of calculating the remaining life of an engine oil within a combustion engine comprising:

determining a composition of a fuel being combusted by the engine using a controller;

selecting, using the controller, a fuel quality penalty factor from a table, the fuel quality penalty factor corresponding to the determined composition of the fuel;

counting the rotations of a component of the engine using an engine revolution counter in communication with the controller;

computing an adjusted revolution count, using the controller, by multiplying the rotations of the component of the engine by the fuel quality penalty factor;

aggregating the adjusted revolution count over a period of time;

comparing the aggregated adjusted revolution count to a threshold in order to determine remaining oil life.

15. The method of claim 14, further comprising providing an alert if the aggregated adjusted revolution count exceeds the threshold.

16. The method of claim 14 wherein determining the composition of the fuel being combusted by the engine includes determining a location of the engine using a global positioning system, and wherein the determined geographic region is indicative of the fuel composition.

17. The method of claim 14 further comprising:

monitoring a temperature of the engine;

selecting a temperature penalty factor from a table, the temperature penalty factor corresponding to the monitored temperature of the engine; and wherein computing an adjusted revolution count further includes multiplying the rotations of the component of the engine by the temperature penalty factor.

18. The method of claim 14, wherein determining a composition of a fuel being combusted by the engine includes analyzing the fuel using a fuel quality sensor.

19. The method of claim 18, wherein monitoring the composition of the fuel includes analyzing the fuel through spectroscopy.

* * * * *